US011172716B2

(12) United States Patent
Smalls

(10) Patent No.: US 11,172,716 B2
(45) Date of Patent: Nov. 16, 2021

(54) SCENTED INSERT HOLDER AND METHOD THEREFOR

(71) Applicant: Samuel L. Smalls, Upper Marlboro, MD (US)

(72) Inventor: Samuel L. Smalls, Upper Marlboro, MD (US)

( * ) Notice: Subject to any disclaimer, the term of this patent is extended or adjusted under 35 U.S.C. 154(b) by 437 days.

(21) Appl. No.: 15/400,036

(22) Filed: Jan. 6, 2017

(65) Prior Publication Data

US 2018/0192717 A1 Jul. 12, 2018

(51) Int. Cl.
*A41D 27/20* (2006.01)
*A41D 25/00* (2006.01)

(52) U.S. Cl.
CPC ..... *A41D 27/20* (2013.01); *A41D 25/003* (2013.01); *A41D 2400/36* (2013.01)

(58) Field of Classification Search
CPC .. A41D 25/003; A41D 2400/36; A41D 27/20; A41D 27/204; A41D 27/205; A41C 3/0035; A41C 3/0042; A44B 6/00; A41B 3/08
USPC ..... 2/144, 145, 249, 251, 266, 247; 450/89; 24/56; D2/609, 859
See application file for complete search history.

(56) References Cited

U.S. PATENT DOCUMENTS 332,310 A * 12/1885 Warshoar ..... A41D 27/20 2/247
517,769 A * 4/1894 Selowsky ..... A41D 25/00 2/144
879,638 A * 2/1908 Hayes ..... A41D 27/20 2/247
1,234,567 A * 7/1917 Quigley ..... A41B 3/06 2/1
1,362,923 A * 12/1920 Callahan ..... A41B 3/08 24/102 E
1,378,061 A * 5/1921 Swain ..... A41B 3/08 2/131
2,389,784 A 11/1945 Kennedy
2,501,917 A 3/1950 Reilly
2,610,325 A 9/1952 Schlussel
2,658,544 A * 11/1953 Osaka ..... A45C 11/24 150/138
3,670,933 A * 6/1972 Jones ..... A44C 5/003 224/222
4,384,369 A * 5/1983 Prince ..... A63B 21/065 2/227
4,797,793 A * 1/1989 Fields ..... A41D 20/00 224/181

(Continued)

FOREIGN PATENT DOCUMENTS

CA 2137710 6/1996
CN 105686121 6/2016

*Primary Examiner* — Clinton T Ostrup
*Assistant Examiner* — Patrick J. Lynch
(74) *Attorney, Agent, or Firm* — Jordan IP Law, LLC

(57) ABSTRACT

A device for storing items on clothes is removably attached to an article of clothing The device is used to hold a scented insert dimensioned to be inserted into the device. The scented insert may allow one to wear cologne or perfume without applying a fragrance to the skin by applying the fragrance to the insert, which could then be inserted into the device. The device has a holder forming a pocket and is removably attached to the clothing. A scented insert is placed within the pocket.

9 Claims, 6 Drawing Sheets

(56) References Cited

U.S. PATENT DOCUMENTS

| | | | | |
|---|---|---|---|---|
| 4,827,536 | A * | 5/1989 | Sung | A44B 6/00 2/145 |
| 4,835,821 | A * | 6/1989 | Durante | A41D 25/003 2/144 |
| 4,875,237 | A * | 10/1989 | Cohen | A41D 3/00 2/94 |
| 5,671,481 | A * | 9/1997 | Giard | A41D 20/00 2/170 |
| 7,252,215 | B1 * | 8/2007 | Furnas, II | A45C 1/04 224/164 |
| 2003/0064009 | A1 | 4/2003 | Baaset | |
| 2004/0133964 | A1 * | 7/2004 | Rudenko | A41D 25/003 2/144 |
| 2004/0187183 | A1 * | 9/2004 | Hautala | A41D 13/0012 2/24 |
| 2009/0019619 | A1 | 1/2009 | Shweky | |
| 2011/0088132 | A1 * | 4/2011 | McNamee-Sollars | A41D 27/12 2/46 |
| 2012/0096628 | A1 * | 4/2012 | Grady | A41D 27/204 2/249 |
| 2013/0174320 | A1 * | 7/2013 | Moye | A41D 20/00 2/170 |
| 2014/0005010 | A1 * | 1/2014 | Kaminsky | A63B 21/065 482/105 |
| 2016/0095372 | A1 * | 4/2016 | Peterson | A41D 27/201 2/248 |
| 2016/0219947 | A1 * | 8/2016 | Nhim | A41D 13/0017 |

* cited by examiner

FIG. 2
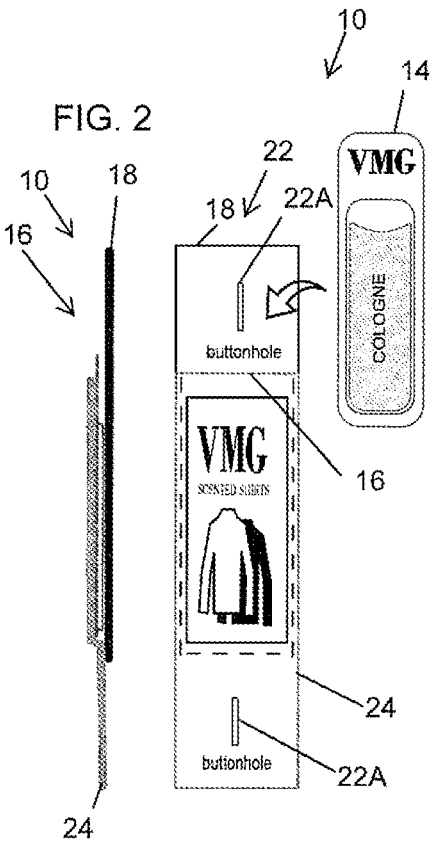
FIG. 1
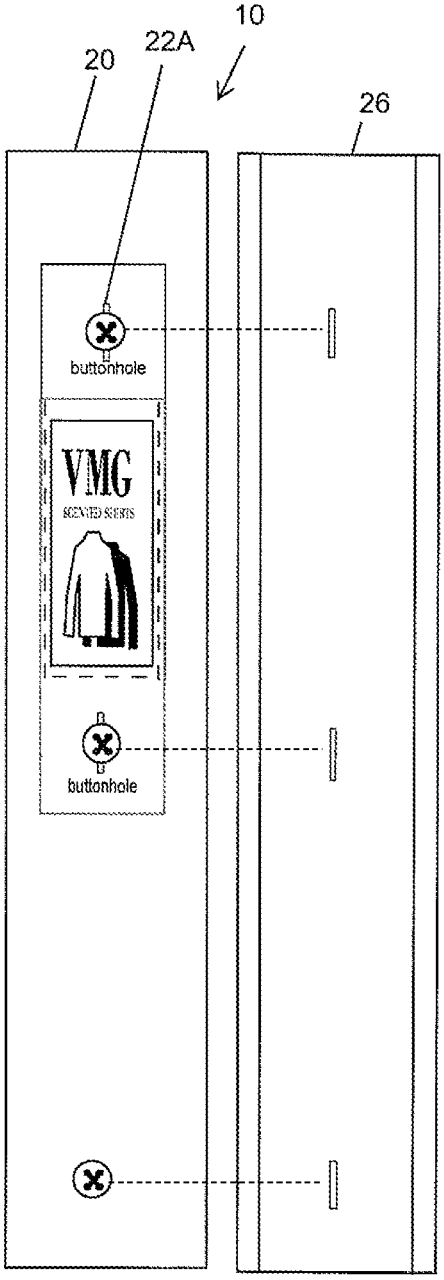
FIG. 3

SCENTED INSERT HOLDER AND METHOD THEREFOR

RELATED APPLICATIONS

This application is related to U.S. Pat. No. 7,036,694 entitled "SCENTED TIE INSERT AND METHOD THEREFOR" in the name of the same inventor as the present application, and which is incorporated by reference into the present application.

TECHNICAL FIELD

The present application generally relates to a holding device, and, more particularly, to an insert holder which may be permanently or removably attached to an article of clothing to hold a scented insert dimensioned to be inserted into the insert holder. The scented insert may allow one to wear cologne or perfume without applying a fragrance to the skin by applying the fragrance to the insert, which could then be inserted into the insert holder.

BACKGROUND

A common supplement to a person's attire comes in the form of cologne, aftershave, and other fragrances. Usually, a fragrance is sprayed or otherwise applied to the skin of the person, often to the neck and face. Unfortunately, some individuals may have allergic reactions to fragrances that come into contact with their skin. The handling of cologne, or other fragrances, by such individuals therefore presents health concerns.

In addition, fragrances such as cologne may be quite expensive. Because of the cost, some people limit their choice to one type of fragrance because the cost of purchasing more than one variety may be cost prohibitive.

Presently, if an individual wanted to use fragrances such as cologne but not apply it to the skin, the individual may apply it to the clothes he/she would be wearing. However, applying cologne and/or perfume to clothes may stain and cause other damage to the clothes. Further, if one were to apply it to the clothes, it may be difficult to remove the scent from the clothes.

Therefore, it would be desirable to provide an apparatus and method that overcome the above problems.

SUMMARY

In accordance with one embodiment, a device for storing items on clothing is disclosed. The device has a holder forming a pocket and attached to the clothing. A scented insert is placed within the pocket.

In accordance with one embodiment, a device for storing items on clothing is disclosed. The device has a holder having a pocket. The holder has at least a first panel attached to the clothing. A scented insert is placed within the pocket.

BRIEF DESCRIPTION OF THE DRAWINGS

The present application is further detailed with respect to the following drawings. These figures are not intended to limit the scope of the present application but rather illustrate certain attributes thereof.

FIG. 1 is a front view of an insert holder in accordance with one aspect of the present application;

FIG. 2 is a side view of an insert holder in accordance with one aspect of the present application;

FIG. 3 is a front view of an insert holder attached to an article of clothing in accordance with one aspect of the present application;

DESCRIPTION OF THE APPLICATION

Figure 4:
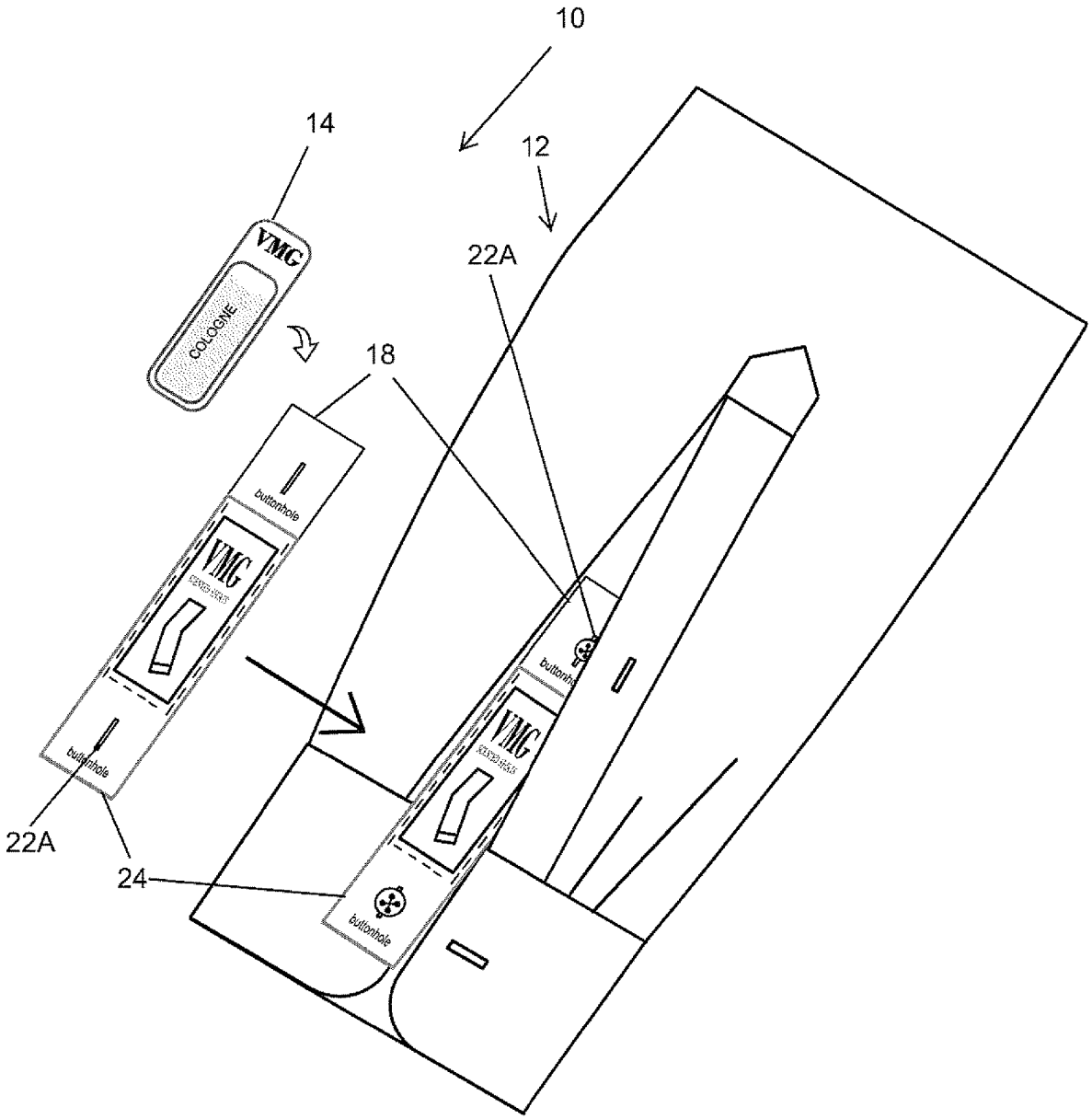
FIG. 4 is an exploded view of an insert holder attached to an article of clothing in accordance with one aspect of the present application.

The description set forth below in connection with the appended drawings is intended as a description of presently preferred embodiments of the disclosure and is not intended to represent the only forms in which the present disclosure may be constructed and/or utilized. The description sets forth the functions and the sequence of steps for constructing and operating the disclosure in connection with the illustrated embodiments. It is to be understood, however, that the same or equivalent functions and sequences may be accomplished by different embodiments that are also intended to be encompassed within the spirit and scope of this disclosure.

Embodiments of the present invention relate to an insert holder. The insert holder may be configured to be removably or permanently attached to a piece of clothing. The insert holder may be used to hold a scented insert. The insert holder may allow a person to wear a fragrance without having the fragrance applied to and coming into contact with the person's skin or other clothing. Unlike cologne, the scented insert can be removed from the insert holder if the scent offends others or is not longer desired. The scented insert is long lasting and there is no need to reapply.

Referring to FIGS. 1-4, one embodiment of a scented insert holder 10 (hereinafter holder 10) may be seen. The holder 10 may be attached to an article of clothing 12. A scented insert 14 may be placed within a pocket area 16 formed within the holder 10. Thus, the holder 10 may allow a person to wear a fragrance without having the fragrance applied to and coming into contact with the person's skin or other clothing. Unlike cologne, the scented insert can be removed from the insert holder if the scent offends others or is not longer desired.

In accordance with the embodiment shown in FIGS. 1-4, the holder 10 may be configured to be removably attached to an item of clothing 12. The holder 10 may be formed of a first panel 18. The first panel 18 may be formed of a cloth material such as a cotton blend, polyester, or the like. The above types of material are given as examples and should not be seen in a limiting manner.

In accordance with the embodiment shown in FIGS. 1-4, the first panel 18 may be rectangular in shape. However, this is shown as an example and should not be seen in a limiting manner. The first panel 18 may come in different geometrical configurations without departing from the spirit and scope of the present invention. The first panel 18 may be dimensioned to be attached on a button area 20 on a shirt (FIG. 3), on a sleeve (FIG. 4), a dress and/or skirt, or other types of clothing having buttons.

An attachment device 22 may be formed on the first panel 18. The attachment device 22 may be used to secure the holder 10 to the article of clothing 12. The attachment device 18 may be formed in a top area of the first panel 18. In accordance with one embodiment, the attachment device 22 may be a buttonhole 22A. The buttonhole 22A may be used to secure the first panel 18 to a button on the button area 20.

The holder 10 may have a second panel 24. The second panel 24 may be formed of a cloth material similar to that of the first panel 18. Alternatively, a mesh type material may be used as will be described below. The second panel 24 may be rectangular in shape. However, this is shown as an example and should not be seen in a limiting manner. The second panel 24 may come in different geometrical configurations without departing from the spirit and scope of the present invention. In general, the second panel 24 may be formed in a similar geometrical configuration as the first panel 18 and dimensioned to be attached on a button area 20 on a shirt, on a sleeve, a dress and/or skirt, or other types of clothing having a buttons.

As may be seen in FIGS. 1-4, the first panel 18 and the second panel 24 may have approximately a same width. The second panel 24 may be attached to the first panel 18 so that a top area of the first panel 18 may be exposed. Side edges and a bottom edge of the first panel 18 may be attached to the second panel 24 such that the pocket area 16 may be formed between the first panel 18 and the second panel 24. The pocket area 16 may be dimensioned to hold the scented insert 14 therein.

The second panel 24 may extend down past a bottom area of the first panel 18. An attachment device 22 may be formed on the second panel 24. The attachment device 22 may be used to secure the holder 10 to the article of clothing 12. The attachment device 22 may be formed in a bottom area of the second panel 24. In accordance with one embodiment, the attachment device 22 may be a buttonhole 22A. The buttonhole 22A may be used to secure the second panel 24 to a button on the button area 20.

In operation, the user may attach the holder 10 to consecutive buttons on the button area 20. The user may then insert the scented insert 14 within the pocket area 16 formed within the holder 10. The user may then button up the clothing so that the portion of the clothing 12 containing the buttonholes 26 is placed over and covers the button area 20 thereby hiding the holder 10 with the scented insert 14. Thus, the holder 10 may allow the user to wear a fragrance without having the fragrance applied to and coming into contact with the person's skin or other clothing. If the second panel 24 is formed of a mesh material, the fragrance from the scented insert 14 may emanate more strongly. As shown, FIGS. 1-3 show the holder 10 removably attached to a button area 20 located on a front of a shirt/blouse while FIG. 4 shows the holder 10 removably attached to a button area 20 located on a sleeve of a shirt/blouse.

Figure 5A:
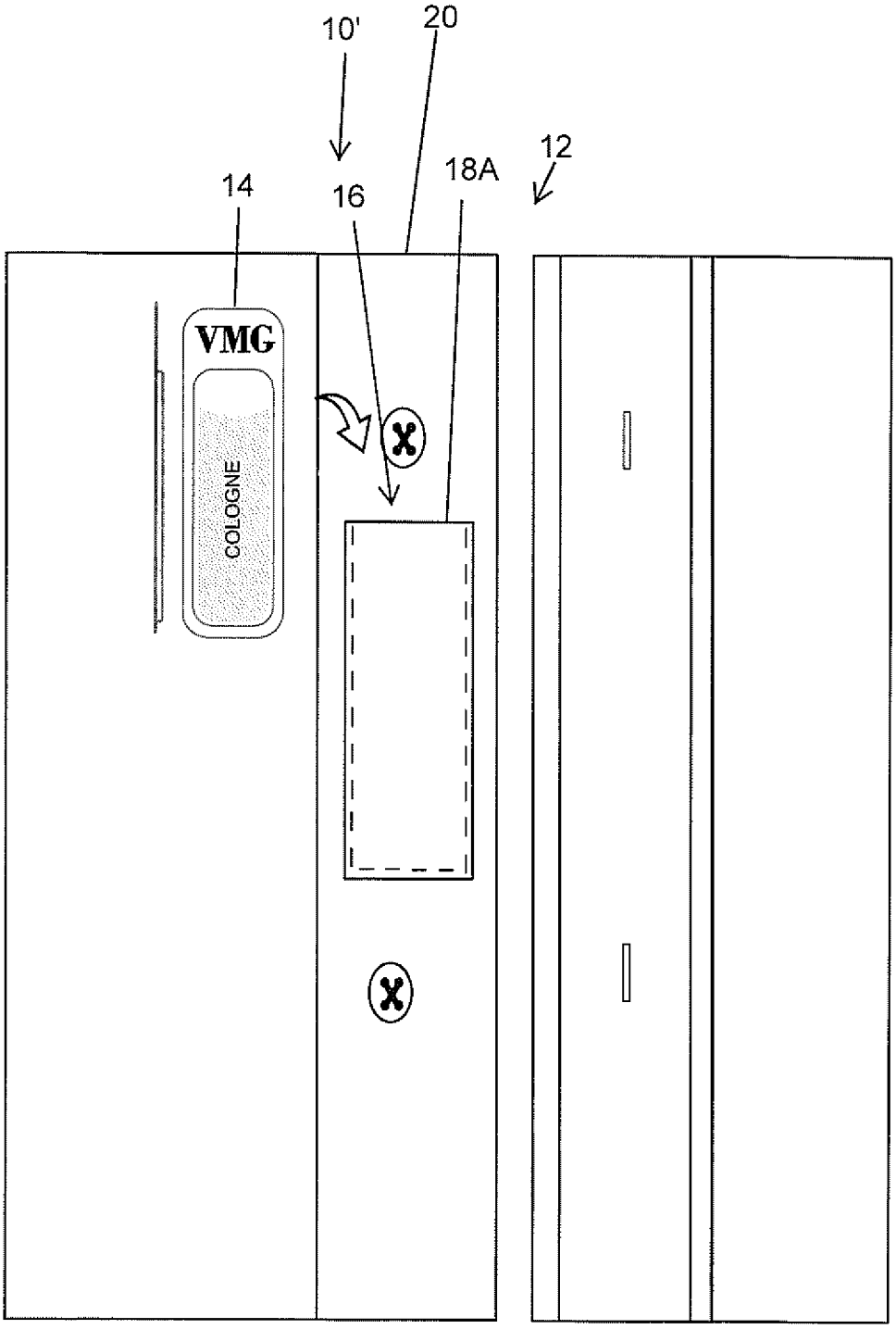
FIG. 5A is a front view of an insert holder permanently attached to an article of clothing in accordance with one aspect of the present application.
Figure 5B:
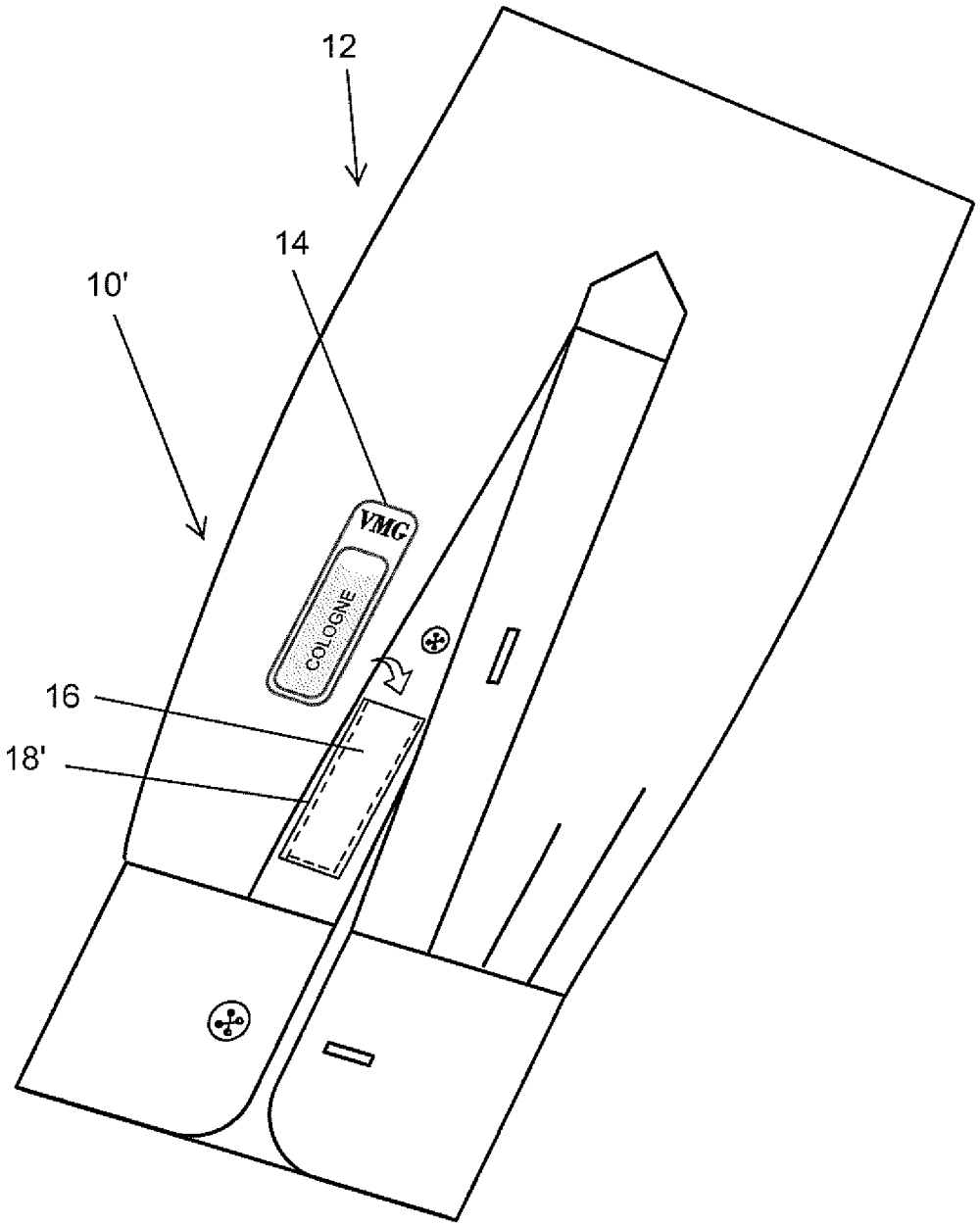
FIG. 5B is a front view of an insert holder permanently attached to an article of clothing in accordance with one aspect of the present application.
Figure 6:
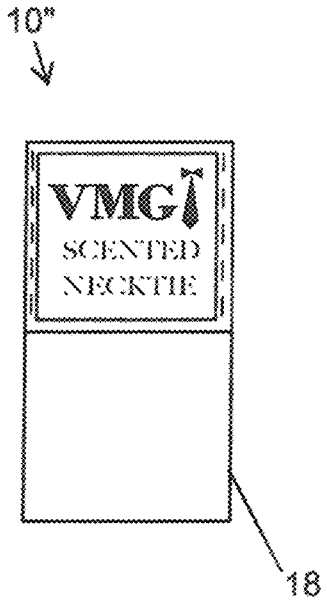
FIG. 6 is a front view of an disassembled insert holder in accordance with one aspect of the present application.
Figure 7:
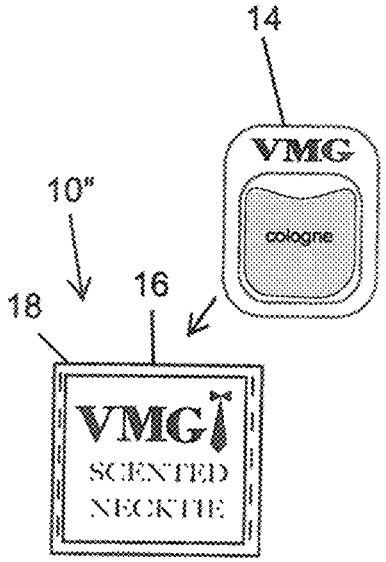
FIG. 7 is a front view of the insert holder of FIG. 6 in accordance with one aspect of the present application.
Figure 8:
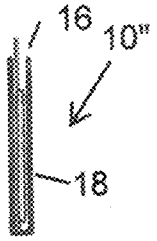
FIG. 8 is a side view of an insert holder in accordance with one aspect of the present application.

Referring to FIGS. 5A-5B, another embodiment of the holder 10' may be seen. The holder 10' may be permanently attached to an article of clothing 12. A scented insert 14 may be placed within a pocket area 16 formed within the holder 10'. Thus, the holder 10' may allow a person to wear a fragrance without having the fragrance applied to and coming into contact with the person's skin or other clothing.

In accordance with the embodiment shown in FIGS. 5A-5B, the holder 10' may be configured to be permanent attached to an item of clothing 12. The holder 10 may be formed of a first panel 18'. The first panel 18' may be formed of a cloth material such as a cotton blend, polyester, or the like. In general, the first panel 18' may be formed of a similar material to that of the clothing 12 to which the holder 10' is attached. The above types of material are given as examples and should not be seen in a limiting manner.

In accordance with the embodiment shown in FIGS. 5A-5B, the first panel 18' may be rectangular in shape. However, this is shown as an example and should not be seen in a limiting manner. The first panel 18' may come in different geometrical configurations without departing from the spirit and scope of the present invention. The first panel 18' may be dimensioned to be attached on a shirt, on a sleeve, a dress and/or skirt, or other types of clothing 12.

The first panel 18' may be permanently attached to the clothing 12. As shown in FIG. 5, the first panel 18' is permanently attached to the button area 20 of the clothing 12. In FIG. 5A, the button area 20 may be on a front panel of a shirt/blouse. In FIG. 5B, the button area 20 may be located on a sleeve of the shirt/blouse. A top edge 18A of the first panel 18' may be unattached to the clothing 12 thereby forming the pocket area 16. In accordance with one embodiment, the first panel 18' may be formed of similar material to that of the article of clothing 12.

In operation, the user may insert the scented insert 14 within the pocket area 16 formed within the holder 10'. The user may then button p the clothing so that the portion of the clothing 12 containing the buttonholes 26 is placed over and covers the button area 20 thereby hiding the holder 10' with the scented insert 14. Thus, the holder 10' may allow the user to wear a fragrance without having the fragrance applied to and coming into contact with the person's skin or other clothing.

Referring to FIG. 6-9, another embodiment of the holder 10" may be seen. The holder 10" may be attached to an article of clothing 12. A scented insert 14 may be placed within a pocket area 16 formed within the holder 10'. Thus, the holder 10' may allow a person to wear a fragrance without having the fragrance applied to and coming into contact with the person's skin or other clothing.

In accordance with the embodiment shown in FIG. 6-9, the holder 10" may be configured to be permanent attached to an item of clothing 12. In the preset embodiment, the clothing 12 may be a necktie 12'. For the necktie 12', the holder 10" may be sewn high on the necktie 12' providing a place for a small end 12" of the necktie 12' to fit preventing it from flapping freely thus allowing wearer to extend the length of their necktie 12'.

The holder 10 may be formed of a first panel 18. The first panel 18 may be formed of a cloth material such as a cotton blend, polyester, or the like. The first panel 18 may be formed of a similar material to that of the clothing 12 to which the holder 10" is attached although it does not have to be. The above types of material are given as examples and should not be seen in a limiting manner.

In accordance with the embodiment shown in FIGS. 6-9, the first panel 18 may be rectangular or square in shape. However, this is shown as an example and should not be seen in a limiting manner. The first panel 18 may come in different geometrical configurations without departing from the spirit and scope of the present invention. The first panel 18 may be dimensioned to be attached on a shirt, on a sleeve, a dress and/or skirt, or other types of clothing 12.

Figure 9:
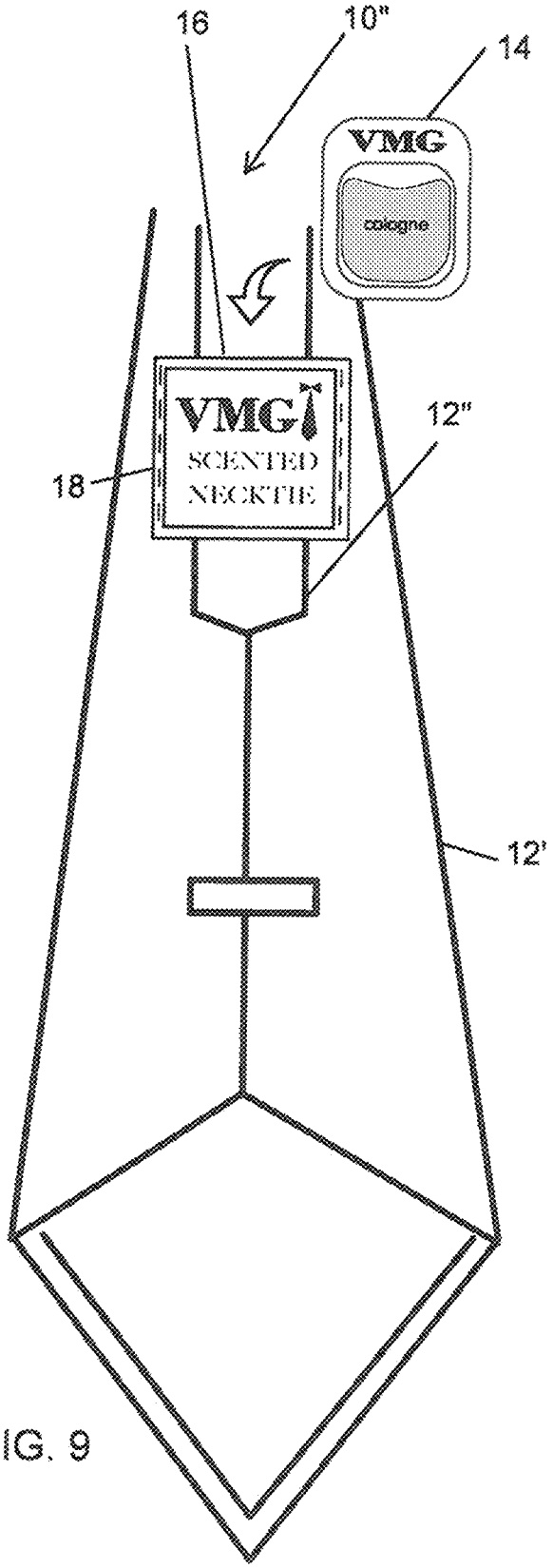
FIG. 9 is a front view of an insert holder permanently attached to an article of clothing in accordance with one aspect of the present application.

The first panel 18 may be folded in half and permanently attached to the clothing 12. As shown in FIG. 9, opposing side edges of the first panel 18 may be permanently attached to the necktie 12'. By only attaching opposing side edges, a passageway may be formed between the holder 10" and the clothing 12. This may allow the smaller end 12" of the necktie 12' to pass through. Thus, the holder 10" may act as a necktie holder.

By folding the first panel 18 in half, the pocket area 16 may be formed. The user may then insert the scented insert 14 within the pocket area 16. Thus, the holder 10 may allow the user to wear a fragrance without having the fragrance applied to and coming into contact with the person's skin or other clothing.

While embodiments of the disclosure have been described in terms of various specific embodiments, those skilled in the art will recognize that the embodiments of the disclosure may be practiced with modifications within the spirit and scope of the claims

The invention claimed is:

1. A device to store items on clothing comprising:

a holder forming a pocket and removably attached to an article of clothing, wherein the pocket is open on one end, and wherein the holder comprises:

a first rectangular panel having a first buttonhole formed in a top area of the first rectangular panel;

a second rectangular panel having a second buttonhole formed in a bottom area of the second rectangular panel, the second rectangular panel attached to the first rectangular panel, wherein the top area of the first rectangular panel extends above the second rectangular panel and is exposed, the second rectangular panel extending below a bottom area of the first rectangular panel and is exposed, side edges and a bottom edge of the first rectangular panel attached to the second rectangular panel forming the pocket; and a scented insert placed within the pocket.

2. The device of claim 1, wherein the first buttonhole formed in the top area of the first rectangular panel is exposed.

3. The device of claim 1, wherein the second buttonhole formed in the bottom area of the second rectangular panel is exposed.

4. The device of claim 1, wherein the first rectangular panel and the second rectangular panel are the same size.

5. The device of claim 1, wherein the first rectangular panel and the second rectangular panel are of equal widths.

6. A device to store items on clothing comprising:

a holder removably attached to an article of clothing and having a pocket, wherein the pocket is open on one end, and wherein the holder comprises:

a first panel having a first buttonhole formed in a top area of the first panel;

a second panel having a second buttonhole formed in a bottom area of the second panel, the second panel attached to the first panel, wherein the top area of the first panel extends above the second panel, the top area of the first panel and the first buttonhole are exposed, the second panel extending below a bottom area of the first panel, the bottom area of the second panel and the second buttonhole are exposed, side edges and a bottom edge of the first panel attached to the second panel forming the pocket; and a scented insert placed within the pocket.

7. The device of claim 6, wherein the first panel and the second panel are the same size.

8. The device of claim 6, wherein the first panel and the second panel are of equal widths.

9. The device of claim 6, wherein the second panel is a mesh material.

* * * * *